United States Patent [19]

Allen

[11] Patent Number: 4,761,522

[45] Date of Patent: Aug. 2, 1988

[54] FINGER OPERATED SWITCHING APPARATUS

[76] Inventor: Donald E. Allen, 1012 W. Eskridge Ave., Stillwater, Okla. 74075

[21] Appl. No.: 915,513

[22] Filed: Oct. 6, 1986

[51] Int. Cl.[4] ..... H01H 25/04; H01H 13/70; B41J 5/08

[52] U.S. Cl. ..... 200/5 R; 400/479; 400/485; 400/489

[58] Field of Search ..... 200/5 R, 5 A, 6 R, 6 A, 200/52 R, 61.27, 61.54, DIG. 2; 400/472, 474, 475, 477, 479, 481, 482, 484, 485, 486, 488, 489; 235/145 R, 145 A

[56] References Cited

U.S. PATENT DOCUMENTS

| | | | |
|---|---|---|---|
| 470,874 | 3/1892 | Glidden | 400/408 |
| 556,422 | 3/1896 | Von Kunowski | 400/489 |
| 674,747 | 5/1901 | Vidal | 400/488 |
| 695,251 | 3/1902 | Vidal | 400/488 |
| 777,651 | 12/1904 | Cahili | 400/101 |
| 1,138,474 | 5/1915 | Heidner | 400/489 |
| 1,200,439 | 10/1916 | Kemble | 400/489 |
| 1,336,151 | 4/1920 | O'Connor | 400/475 |
| 1,652,464 | 12/1927 | Tyberg | 400/489 |
| 1,678,334 | 7/1928 | Fischer | 400/489 |
| 2,318,519 | 5/1943 | Palanque | 400/482 |
| 3,633,724 | 1/1972 | Samuel | 400/485 |
| 3,693,184 | 9/1972 | Maling | 360/4 |
| 3,929,216 | 12/1975 | Einbinder | 400/484 |
| 3,945,482 | 3/1976 | Einbinder | 400/486 |
| 3,950,634 | 4/1976 | Speiser | 235/145 R |
| 4,029,915 | 6/1977 | Ojima | 364/709 |
| 4,042,777 | 8/1977 | Bequaert et al. | 178/79 |
| 4,065,650 | 12/1977 | Lou | 200/5 A X |
| 4,067,431 | 1/1978 | Whitaker | 400/485 |
| 4,081,068 | 3/1978 | Zapp | 400/474 |
| 4,096,935 | 6/1978 | Hanakata et al. | 400/479 |
| 4,201,489 | 5/1980 | Zapp | 400/485 |
| 4,265,557 | 5/1981 | Runge | 400/479 |
| 4,274,752 | 6/1981 | Huber et al. | 400/477 |
| 4,313,685 | 2/1982 | Stahl et al. | 400/479 |
| 4,332,493 | 6/1982 | Einbinder | 400/484 |
| 4,349,286 | 9/1982 | Blaser et al. | 400/492 |
| 4,440,515 | 4/1984 | Nassimbene | 400/479 |
| 4,443,789 | 4/1984 | Endfield et al. | 340/365 R |
| 4,449,839 | 5/1984 | Bleuer | 400/485 |
| 4,467,150 | 8/1984 | Leitermann et al. | 200/5 A |
| 4,480,937 | 11/1984 | Eckhardt | 400/479 |
| 4,506,118 | 3/1985 | Mollman | 200/5 R |
| 4,517,424 | 5/1985 | Kroczynski | 200/5 R X |
| 4,553,009 | 11/1985 | Van Zeeland et al. | 200/340 |
| 4,579,470 | 4/1986 | Casey | 400/489 |
| 4,582,967 | 4/1986 | Brumit et al. | 200/5 A |
| 4,584,443 | 4/1986 | Yaeger | 200/6 A |

FOREIGN PATENT DOCUMENTS

| | | | |
|---|---|---|---|
| 622694 | 9/1978 | U.S.S.R. | 400/479 |

OTHER PUBLICATIONS

Kowalski, D. C.; Xerox Disclosure Journal; "Semi--Captive Keyboard"; vol. 1, No. 2, Feb. 1976, p. 85.

*Primary Examiner*—J. R. Scott

*Attorney, Agent, or Firm*—Alan T. McCollom

[57] ABSTRACT

A keyboard includes a plurality of keys thereon, each of which is capable of three different switching actions for entry of data or commands into a word processor, typewriter, computer or the like. Each key includes a first inclined surface for generating a first switching action responsive to finger contraction, a second inclined surface for generating a second switching action responsive to finger extension, and a horizontal surface for actuating a third switching action responsive to finger depression. Each key is connected to a respective switch. Each switch includes a carriage operating horizontally against spring-loaded horizontal plugs. The carriage houses a spring-loaded vertical stem attached to the respective key.

11 Claims, 4 Drawing Sheets

FINGER OPERATED SWITCHING APPARATUS

BACKGROUND AND SUMMARY OF THE INVENTION

The instant invention relates to finger operated switching apparatus and more particularly to such apparatus which is used by an operator to enter data into a computer, word processor, typewriter or the like.

A conventional typewriter keyboard includes several horizontal rows of keys oriented transversely to an operator. The conventional arrangement of letters on such a keyboard is sometimes referred to as the QWERTY format after the first six letters on the top row of letter keys. The QWERTY format was developed in the late 1800's and has remained the standard keyboard format to date for typewriters as well as for computers, word processors, and other data entry terminals.

The QWERTY format keyboard suffers from several disadvantages. Hand movement up and down the keyboard is required to position the fingers for striking keys at the upper and lower portions of the board. Even when it is not necessary to move the entire hand, substantial finger movement is required to move the finger between keys on adjacent rows or between adjacent keys on the same row. Such hand and finger movement decreases the rate at which an operator can enter data via the keyboard.

A number of prior art designs have attempted to improve upon the QWERTY format. For example, U.S. Pat. No. 4,584,443 to Yeager discloses a captive digit input device which includes a set of cups into which an operator's fingertips are received. Data is entered by depressing the cup along the axis of the finger and by pivoting the finger toward and away from the operator. Although the Yeager device reduces the amount of hand and finger travel required from that necessary on a QWERTY format keyboard, it suffers from several disadvantages. First, two of the data entry movements, pivoting a finger both toward and away from the operator, are awkward relative to other types of finger movements, e.g., finger extension and contraction. Secondly, the cups in the Yeager device must be custom-designed for users having different sized fingers.

U.S. Pat. No. 3,945,482 to Einbinder discloses orthogonal input keyboards in which multiple keys present horizontal and angled keyboard surfaces toward a single finger. The Einbinder keyboard design requires different keys to be differently shaped, thereby increasing the expense of manufacturing such a keyboard, and requires more finger travel to strike various keys than is desirable.

The finger operated switching apparatus of the invention comprises a key having a substantially horizontal switching axis and a substantially vertical switching axis. The key includes a horizontal surface over which the tip of an operator's finger may be positioned for applying downward force to the key along the vertical switching axis. A first inclined surface is formed on the key adjacent the horizontal surface with the front of the operator's finger being presented toward the first inclined surface, when the tip thereof is so positioned, for applying force to the key in one direction along the horizontal switching axis responsive to finger contraction. A second inclined surface is formed on the key adjacent the horizontal surface with the rear of the operator's finger being presented toward the second inclined surface, when the tip thereof is so positioned, for applying force to the key in the other direction along the horizontal switching axis responsive to finger extension. In another aspect of the invention, a plurality of such keys are provided on a keyboard for accommodating all of the operator's fingers during data entry operations. In yet another aspect of the invention, data entry of the ten most commonly occuring characters is effected by depressing a selected finger or thumb, data entry of the next ten most commonly occurring characters is effected by contracting a selected finger-or thumb and data entry of the remaining characters is effected by extending a selected finger or thumb. In still another aspect of the invention, the keys on such a keyboard are positioned laterally and vertically so that the horizontal surfaces thereof substantially simultaneously contact the fingertips and thumb of an operator's relaxed cupped hand as it is moved into position for switching the keys.

It is an object of the present invention to provide finger operated switching apparatus for entering data wherein both hand and finger travel are substantially reduced over that required by prior art devices thereby increasing the rate at which an operator may enter data.

It is another object of the invention to provide such an apparatus which is usable by operators having different-sized fingers.

BRIEF DESCRIPTION OF THE DRAWINGS

These and other objects and advantages of the instant invention will be readily apparent to a person having ordinary skill in the art when the following detailed description is read in view of the accompanying drawings wherein.

DETAILED DESCRIPTION OF THE PREFERRED EMBODIMENTS OF THE INVENTION

Figure 1:
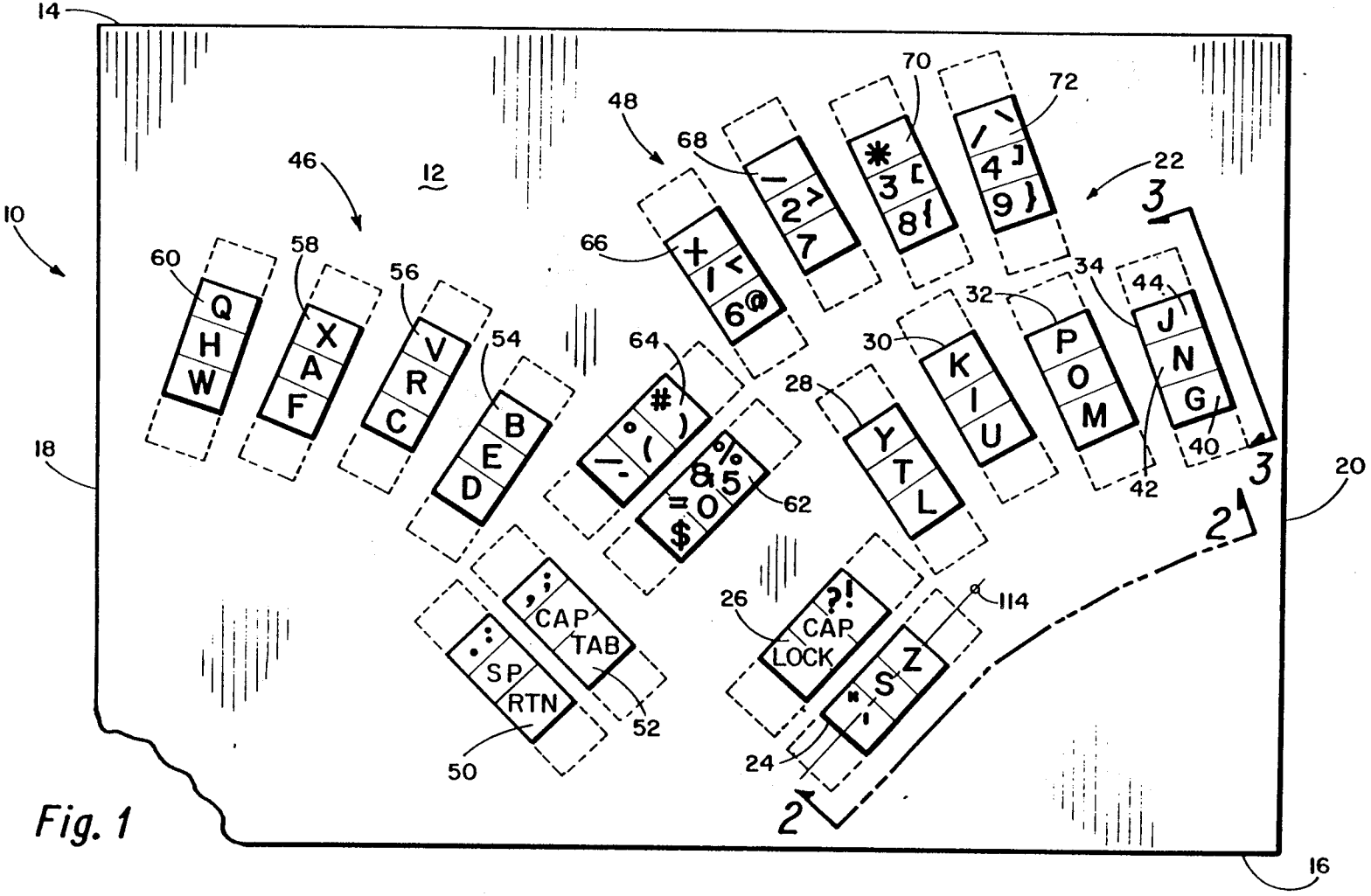
FIG. 1 is a top plan view of a keyboard constructed in accordance with the instant invention.
Figure 2:
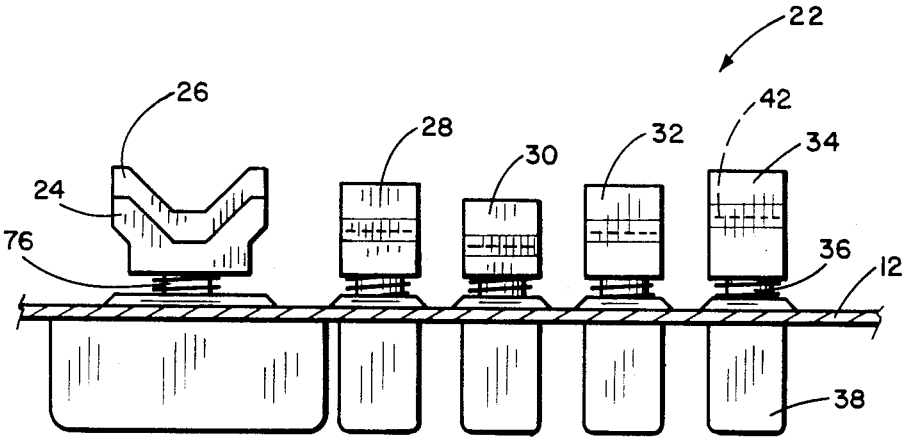
FIG. 2 is a view taken along line 2—2 in FIG. 1.
Figure 3:
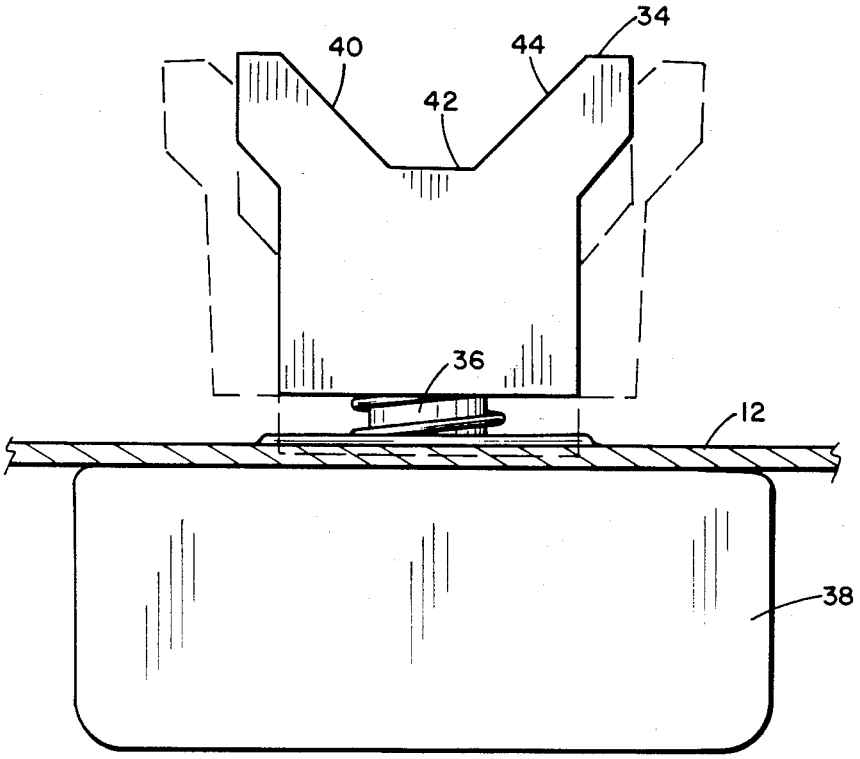
FIG. 3 is an enlarged view taken along line 3—3 in FIG. 1.

Considering now in detail the structure of the first embodiment of the invention, attention is directed to FIGS. 1–3 wherein indicated generally at 10 is a keyboard constructed in accordance with the instant invention. Keyboard 10 includes a base 12 having upper and lower sides 14, 16 and left and right sides 18, 20. The keyboard is connected to a conventional word processor (not shown) and, as will be explained hereinafter, is used to enter letters and numbers into the word processor for generating typed documents.

Indicated generally at 22 is a first set of keys. Included therein are thumb keys 24, 26 and finger keys 28, 30, 32, 34. Each of the keys is mounted on a post which extends upwardly from a switch mounted on the underside of base 12, like key 34 is mounted on post 36 which extends upwardly from switch 38. The keys on keyboard 10 are substantially identical to one another, except for variations in height, as are each of the switches.

In the view of FIG. 1, the switch associated with each key beneath base 12 is shown in dashed lines.

Considering now the structure of key 34, a first inclined surface 40 assumes an angle of substantially 45° to a horizontal surface 42. A second inclined surface 44 is opposed to first inclined surface 40 and is also at an angle substantially 45° with respect to horizontal surface 42. In the instant embodiment of the invention, the distance from the end of inclined surface 40 adjacent horizontal surface 42 to the other end of inclined surface 40 is substantially 1.0 centimeter. The distance between the end of horizontal surface 42 adjacent surface 40 to the opposite end of surface 42 is substantially 0.8 centimeters. The distance from the juncture of surfaces 42, 44 to the other end of surface 44 is also 1.0 centimeter.

As can best be seen in FIG. 2, the first set of keys 22 includes, keys having three different heights. Keys 24, 30 are the same height; keys 28, 32 are the same height; and keys 26, 34 are the same height. Each of the keys includes horizontal and inclined surfaces, like those on key 34, which have substantially the same dimensions as surfaces 40, 42, 44. The configuration of key set 22 accommodates the relaxed fingers of the cupped hand of an operator in the following manner: the tip of the middle finger is positioned on the horizontal surface, shown in dashed lines in FIG. 2, of key 30 while the first and third fingertips are placed on the horizontal surfaces of keys 28, 32, respectively and the fourth is placed on surface 42. The edge of the operator's thumb is placed on the horizontal surface of key 24 with the edge of the thumb being moveable to the horizontal surface of key 26 for effecting actuation of both keys 24, 26 as will hereinafter be more fully described.

Returning again tb FIG. 1, indicated generally at 46 is a second set of keys and indicated generally at 48 is a third set of keys. Set 46 includes therein a first thumb key 50, a second thumb key 52 and finger keys 54, 56, 58, 60. Key set 48 includes therein first and second thumb keys 62, 64, respectively, and finger keys 66, 68, 70, 72. The keys in set 46 are symmetrical with respect to the keys in set 22 with, e.g., key 56 being identical to key 30, keys 54, 58 being identical to keys 28, 32, etc. Thus, an operator's left hand is used to enter data, in a manner which will hereinafter be more fully described, with key set 46 while the right hand is used on key set 22.

Key set 48 is substantially identical to key set 22 except for the fact that each of the keys in set 48 is elevated by one centimeter over the corresponding key in set 22 by virtue of the elevation of base 12 by one centimeter. Thus an operator can move his or her right hand from key set 22 by raising the hand 1 centimeter and extending it slightly until the fingers are received over the horizontal surfaces of key set 48 in the same manner as received over the keys in set 22.

The angles of the keys relative to the edges of the keyboard 10 and to each other are accurately depicted in FIG. 1.

Figure 4:
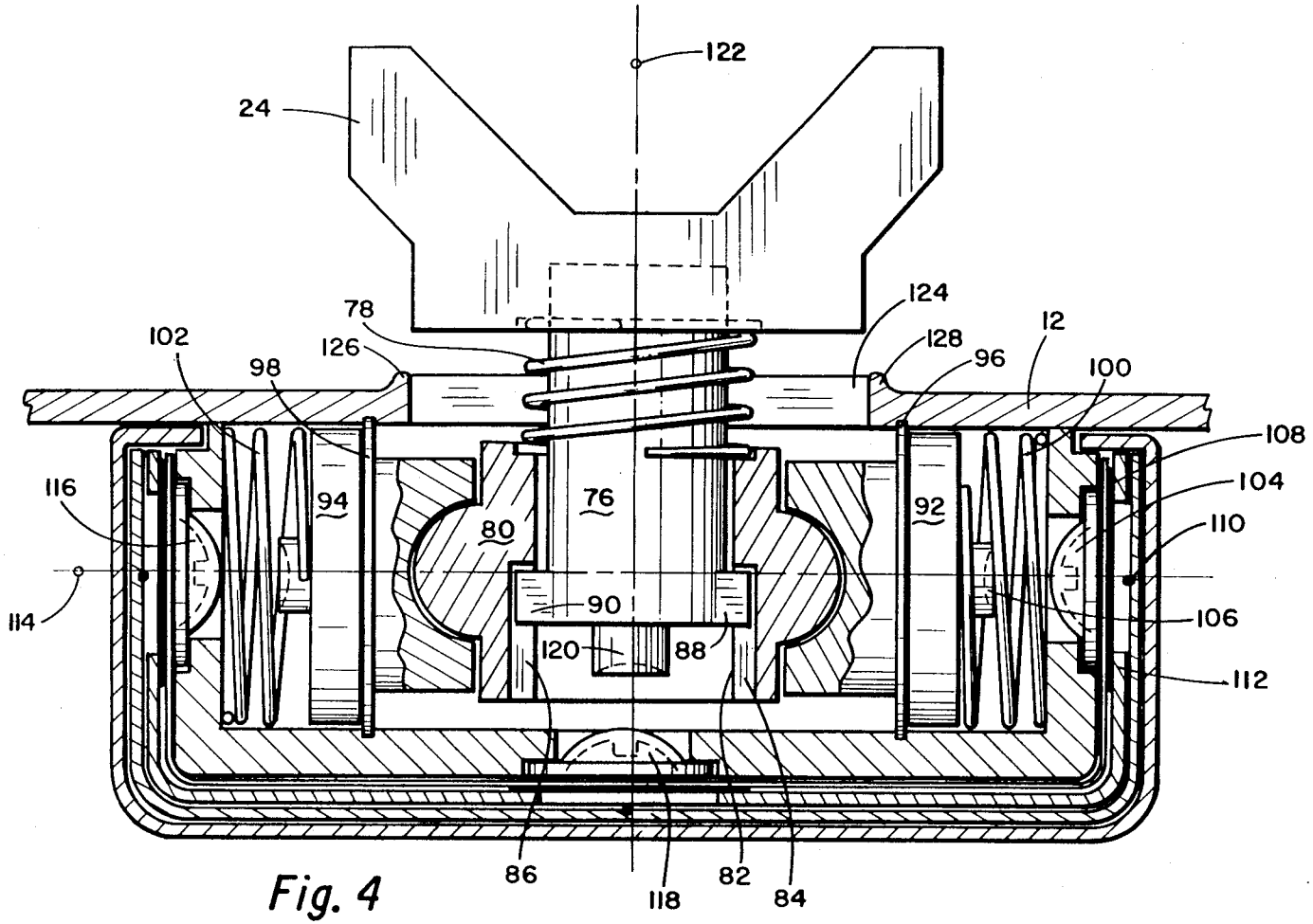
FIG. 4 is an enlarged view shown partly in cross-section of one of the key and switch combinations in the keyboard of FIG. 1.

Turning now to FIG. 4, depicted therein is an enlarged view of key 24, in FIG. 2, and its associated switch shown partly in cross-section. Key 24 is mounted on a post 76 which is biased upwardly under the action of a spring 78. The lower end of the post is received in a spring carriage 80 which includes a downward facing cylindrical bore 82 into which the lower end of the post is received. A pair of slots 84, 86 receive tabs 88, 90 on the lower end of the post and restrain the post from rotational movement. Adjacent either end of carriage 80 are a pair of lateral contact plugs 92, 94. Each of the plugs extend through and abut against, in the view of FIG. 4, a snap ring 96, 98. Springs 100, 102 bias plugs 92, 94, and hence carriage 80, to a centered positioned as shown in FIG. 4. A plastic snap dome 104 is directed toward a lug 106 which extends from the end of plug 92. A first conductor 108 is separated from a second conductor 110 by an insulator 112. Briefly describing the operation of the key and switch assembly depicted in FIG. 4, when force is applied to key 24 along axis 114 in the direction of dome 104, lug 106 strikes the dome and collapses it. The lug 106 urges conductor 108 against conductor 110 thereby making electrical contact between the two. When key 24 is released, the action of spring 100 biases the assembly back into the configuration shown in FIG. 4. A second plastic dome 116 includes associated conductors (and an insulator) which are electrically connected in the same manner as described for conductors 108, 110 when force is applied to key 24 along axis 114 in the direction of plastic dome 116.

A third plastic dome 118 is positioned beneath post 76. Dome 118 collapses in the manner as previously described for the other domes when a lug 120 on the lower end of post 76 is urged thereagainst thus enabling the lug to make electrical contact between the two conductors located beneath the plastic dome. Lug 120 is urged against dome 118 by applying downward pressure to key 24 along axis 122. After contact is made, and when the operator removes his or her finger from key 24, spring 78 returns the assembly to the configuration shown in FIG. 4.

Each of the three switching contacts on each of the switches in FIG. 1 is connected to the word processor (not shown) in a conventional manner to effect either character entry into the word processor or to effect an operating function of the word processor. The characters and functions are snown on the keys in FIG. 1 and will be described in more detail hereinafter.

In FIG. 3, the dashed-lined depictions of switch 34 illustrate the position of the key when moved to each of the switching positions, i.e., completely to the right, completely to the left, and complete depressed. Each switching movement from the configuration of FIG. 4 requires approximately 0.4 centimeter of travel, i.e., when key 24 is urged completely to the right to make connection between conductors 108, 110 it travels approximately 0.4 centimeter, the same distance required for complete movement to the left and for complete depression of the key.

It should be noted that opening 124 in base 12 is sized so that key 24 just fits therethrough when depressed for actuating the contacts beneath post 76. Lips 126, 128 on either side of opening 124 catch and direct the lower portion of key 24 when lateral movement is being effected in the event that some vertical downward force is also applied to the key. In other words, the lip permits lateral force to pull the key thereover in order to apply force in either direction along axis 114 and prevents post 76 from actuating the contacts therebeneath In operation, the fingertips of an operator's right hand are positioned over the horizontal surfaces in key set 22 with the edge of the thumb normally being positioned over the horizontal surface of key 24. The operator's left hand fingertips are positioned over the corresponding surfaces in key set 46. When it is desired to make electrical connection between one of the three sets of conductors controlled by each key, the operator's finger is either extended, thereby striking the distal inclined surface and urging the key along the lateral axis, ike lateral axis 114, until electrical contact is made. Alternatively, the operator's finger is contracted, thereby urging the fingertip against the other inclined surface and in effect pulling the key along axis 114 until the opposed electrical contact is made. In making the third switching action the operator's finger is simply depressed thereby making electrical contact between the conductors located beneath the switch post. It is to be appreciated that thumb contraction of the right hand urges key 24 toward finger keys 28–34 while thumb extension moves key 24 away therefrom with thumb depression being effected by urging the *side* of the thumb downwardly against the key. The left hand thumb operates in a similar fashion on key 50 with both thumbs being moveable to upper key 26 (right thumb) and upper key 52 (left thumb) to perform certain conventional word processing operations and to enter certain punctuation marks as shown on the keys.

Each key is marked with the number, letter, or operation which is entered or performed when the key is actuated. Each letter or symbol is located on the portion of the key which enters the same or produces the operation. For example, when the first finger is received over the horizontal surface on key 28 depression of the key enters "t" into the word processor. Extension of the finger urges the switch outwardly along the lateral key axis thereby entering "y" while contraction urges the key toward the operator thereby entering "1". When more than one character appears on a horizontal or inclined surface, the other character is entered when the "cap" key is depressed in the same manner as on conventional typewriters.

Second finger key 30 is oriented so that the longitudinal axis of the operator's right middle finger is in alignment with the right forearm axis when the right hand is positioned over key set 22 as previously described. This same relationship holds for the operator's left middle finger and forearm when the left hand is positioned over key set 46. Each of the other keys are angled so that the lateral axis of each key is aligned with the axis of finger extension and contraction for each finger.

The letters assigned to the various switching actions of key sets 22, 46 are assigned so that the most commonly occuring letters in the English language, on the average, are assigned to key switching positions which are actuated oy depressing a selected key, those being letters H, A, R, E, S, T, I, O, N. The space operation designated "SP" on key 50 is also effected by thumb depression due to the relatively high frequency of its use. The next most commonly occuring letters (and the period on thumb key 50) are assigned switching positions so that selection of these letters is effected by moving a selected key along its lateral axis as a result of finger contraction, those letters being W, F, C, D, Z, L, U, M, G. The remaining letters are entered by movement along a key lateral axis as a result of finger extension, those letters being Q, X, V, B, Y, K, P, J. Thus, the most efficient finger movement (depression) will be the most utilized, while the second most efficient finger movement (contraction) will be the second most utilized, with finger extension, the least efficient movement, being the least utilized.

Key set 48 is also designed to accommodate the right hand and may be used to enter the characters shown of those keys in FIG. 1 by moving the right hand from key set 22 to key set 48.

Figure 5:
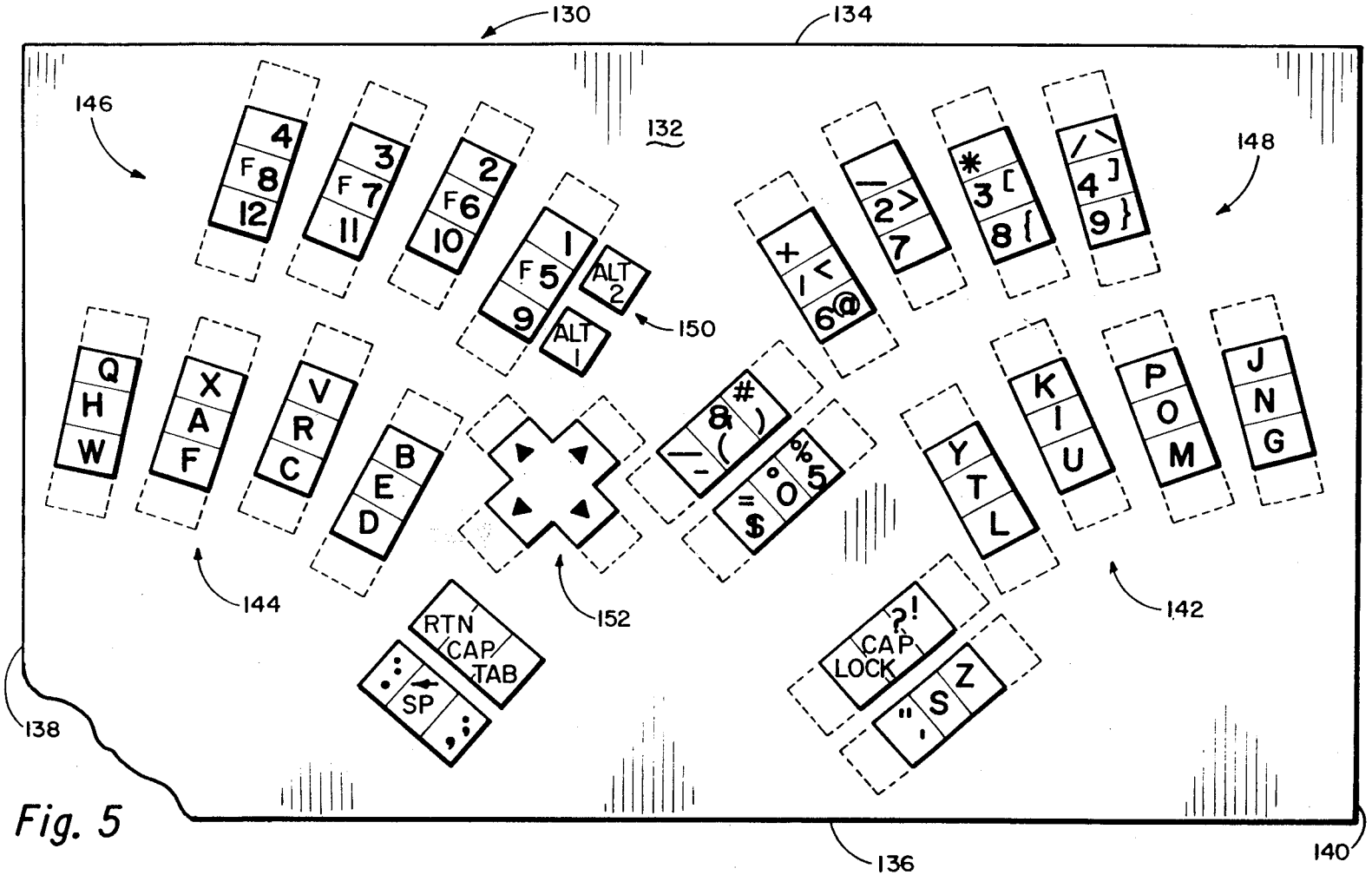
FIG. 5 is a view similar to FIG. 1 of a second embodiment of the invention.

Turning now to FIG. 5, consideration will be given to a second embodiment of the instant invention. Indicated generally at 130 is a keyboard constructed in accordance with the instant invention. The keyboard includes therein a base 132 having upper and lower sides 134, 136 and left and right sides 138, 140. The keyboard is connected to a computer and is used by an operator to enter letters and numbers into the computer Keyboard 130 includes four key sets 142, 144, 146, 148. Key sets 142, 144 are for the right and left hands, respectively, of an operator and correspond in structure and operation to key sets 22, 46 in FIG. 1 except that certain of the functions controlled by the left thumb in key set 144 are different from the functions and punctuation associated with left thumb keys 50, 52 in key set 46.

Both of key sets 146, 148 are elevated 1 centimeter above key sets 142, 144 by virtue of elevation of base 132. In addition, the right hand key sets in FIG. 5 are rotated approximately 5° clock-wise from the right hand key sets in FIG. 1 while the left hand key sets in FIG. 5 are rotated approximately 5° counter clock-wise from the left hand key set in FIG. 1. The slight outward rotation of each of the key sets in FIG. 5 accommodates all of the keys on a slightly smaller board than if the same angle were used. Like FIG. 1, FIG. 5 is a scale drawing depicting the angles of the keys relative to the base sides (and to each other) accurately.

FIG. 5 also includes a pair of computer function control keys, indicated generally at 150 and a four-position cursor control key 152. The cursor control key moves a conventional cursor on the computer screen (not shown) up, down, left, or right depending upon which of the four key directions is selected on cursor control key 152.

Operation of keyboard 130 is substantially the same as the operation of the keyboard described in FIG. 1. Initially, the operator's right and left hands are placed over the horizontal surfaces on the right hand key set 142 and left hand key set 144, respectively. Characters and operations are entered by finger extension, contraction, and depression. When it is necessary to enter a character or generate a control which is actuated by one of the keys in key set 146 or key set 148, the right or left hand (or both) is moved up approximately 1 centimeter and is extended to the outer key sets. Switching of the outer key sets for entry of characters and commands to the computer is effected in the same manner as for key sets 142, 144.

It is to be appreciated that additions and modifications may be made to the embodiments of the invention disclosed herein without departing from the spirit of the invention which is defined in the following claims.

What is claimed is:

1. Finger operated switching apparatus comprising a key and switch combination including:

a switch including:

first contacts actuated by force applied to said switch along a substantially horizontal axis in one direction, first contact engagement means, disposed to reciprocatingly move along said horizontal axis, for engaging said first contacts so that said first contacts electrically connect, second contacts actuated by force applied to said switch along said horizontal axis in a direction substantially opposite to said one direction, second contact engagement means, disposed to reciprocatingly move along said horizontal axis, for engaging said second contacts so that said second contacts electrically connect, third contacts actuated by downward force applied to said switching mechanism along an axis substantially normal to said horizontal axis, third contact engagement means, disposed to reciprocatingly move along said axis substantially normal to said horizontal axis, for engaging said third contacts so that said third contacts electrically connect, and means for coupling said third contact engagement means with said first and second contact engagement means so that reciprocating movement of said third engagement means along said axis substantially normal to said horizontal axis is not communicated to said first and second contact engagement means but so that movement of said third engagement means along said horizontal axis is communicated to at least one of said first and second engagement means; and a key mounted on said third contact engagement means and being constructed to accommodate a finger for applying such forces to said switch, said key including:

a first inclined surface for receiving a force applied to said first inclined surface as a result of finger contraction so that said key and said third contact engagement means are pulled in said one direction, thereby moving said first contact engagement means into engagement with said first contacts, a second inclined surface for receiving a force applied to said second inclined surface as a result of finger extension so that said key and said third contact engagement means are pushed in said one direction substantially opposite to said one direction, thereby moving said second contact engagement means into engagement with said second contacts, and a horizontal surface extending between said first and second inclined surfaces for receiving a force applied to said horizontal surface as a result of finger depression so that said key and said third contact engagement means are depressed towards said third contacts, thereby moving said third contact engagement means into engagement with said third contacts.

2. The apparatus of claim 1 wherein said first and second inclined surfaces are at an angle of substantially 45° to said horizontal surface.

3. The apparatus of claim 1 wherein said key and switch combination is mounted on a keyboard; and wherein said apparatus further includes three additional key and switch combinations mounted on said keyboard, said additional key and switch combinations being substantially identical to said first-mentioned key and switch combination and all said key and switch combinations being arranged to permit each of the four finger tips on an operator's hand to be simultaneously positioned over the horizontal surface of a respective one of said key and switch combinations; and wherein the horizontal axes of all said key and switch combinations converge toward one another on the side of the keys of said combinations having the first inclined surfaces formed thereon.

4. The apparatus of claim 3 wherein said apparatus further includes a thumb key mounted on said keyboard, said thumb key being substantially identical to said other, keys and being arranged to permit the side of an operator's thumb to be positioned over the horizontal surface on said thumb key when the tips of the operator's fingers adjacent said thumb are positioned over different one of said four other keys.

5. Finger operated switching apparatus comprising:

a switch having a first axis of operation and a second axis of operation, said switch including:

a first pair of electrical conductors spaced from each other, a first snap dome disposed adjacent one of the conductors of said first pair, a first contact plug including a first lug protruding therefrom so that said first lug engages said first snap dome in response to movement of said first contact plug in a first direction along said first axis of operation, a second pair of electrical conductors spaced from each other, a second snap dome disposed adjacent one of the conductors of said second pair, a second contact plug including a second lug protruding therefrom so that said second lug engages said second snap dome in response to movement of said second contact plug in a second direction along said first axis of operation, a spring carriage disposed between said first and second contact plugs and in engagement therewith so that movement of said spring carriage along said first axis of operation from a centered position moves a respective one of said first and second contact plugs towards the respective snap dome associated therewith, said spring carriage including a surface defining a bore therethrough, a first spring disposed between said first snap dome and said first contact plug and a second spring disposed between said second snap dome and said second contact plug so that said first and second springs cooperate to dispose said spring carriage at said centered position when no external force is moving said spring carriage towards one of said contact plugs, a third pair of electrical conductors spaced from each other, a third snap dome disposed adjacent one of the conductors of said third pair, a post including a third lug protruding therefrom so that said third lug engages said third snap dome in response to movement of said post in a first direction along said second axis of operation, and a third spring carried on said spring carriage and disposed adjacent an end of said post opposite said third lug; and a key connected to said post so that said third spring is disposed between said key and said spring carriage, said key including interior surfaces defining a recess for receiving a finger tip of an operator of said apparatus so that depressing the finger tip moves said post along said second axis of operation to collapse said third snap dome against the adjacent electrical conductor for electrically contacting the conductors of said third pair together, so that contracting the finger tip moves said first contact plug along said first axis of operation to collapse said first snap dome against the adjacent electrical conductor for electrically contacting the conductors of said first pair together, and so that extending the finger tip moves said second contact plug along said first axis of operation to collapse said second snap dome against the adjacent electrical conductor for electrically contacting the conductors of said second pair together.

6. An apparatus as defined in claim 5, wherein:

said spring carriage includes a slot defined therein; and said post includes a tab extending radially therefrom, said tab disposed within said slot so that said post is not rotatable relative to said spring carriage.

7. An apparatus as defined in claim 5, wherein:

said apparatus further comprises a base including an opening defined therethrough;

said switch is connected to said base so that said post extends through said opening; and said base further includes a lip disposed adjacent said opening so that said lip engages said key to prevent further movement of said post along said second axis of operation in response to a force applied to said key primarily for moving said spring carriage along said first axis of operation.

8. An apparatus as defined in claim 5, wherein said first snap dome, said first contact plug, said spring carriage, said second contact plug, and said second snap dome are aligned along said first axis of operation.

9. An apparatus as defined in claim 5, wherein said interior surfaces of said key include:

a flat surface extending parallel to said first axis of operation, said flat surface receiving the force when the finger tip of the operator is depressed;

a straight first inclined surface extending away from an edge of said flat surface, said first inclined surface receiving the force when the finger tip of the operator is contracted; and a straight second inclined surface extending away from another edge of said flat surface opposite said first inclined surface, said second inclined surface receiving the force when the finger tip of the operator is extended.

10. Finger operated switching apparatus comprising:

a base;

a first set of four key-switch assembly means connected to said base for receiving the right-hand finger tips of an operator of said apparatus and for responding to depression, contraction and extension of said right-hand finger tips;

a second set of four key-switch assembly means connected to said base for receiving the left-hand finger tips of the operator and for responding to depression, contraction and extension of said left-hand finger tips;

wherein each of said key-switch assembly means includes:

first contacts actuated by force applied to said switch along a horizontal axis in one direction, first contact engagement means, disposed to move along said horizontal axis, for engaging said first contacts so that said first contacts electrically connect, second contact actuated by force applied to said switch along said horizontal axis in a direction opposite to said one direction, second contact engagement means, disposed to move along said horizontal axis, for engaging said second contacts so that said second contacts electrically connect, third contacts actuated by downward force applied to said switching mechanism along a vertical axis, third contact engagement means, disposed to move along said vertical axis, for engaging said third contacts so that said third contacts electrically connect, means for coupling said third contact engagement means with said first and second contact engagement means so that movement of said third engagement means along said vertical axis is not communicated to said first and second contact engagement means but so that movement of said third engagement means along said horizontal axis is communicated to said first and second engagement means, and a key connected to said third contact engagement means, said key including:

a first inclined surface for receiving a force applied to said first inclined surface as a result of finger contraction so that said key and said third contact engagement means are pulled in said one direction, thereby moving said first contact engagement means into engagement with said first contacts, a second inclined surface for receiving a force applied to said second inclined surface as a result of finger extension, so that said key and said third contact engagement means are pushed in said direction opposite to said one direction, thereby moving said second contact engagement means into engagement with said second contacts, and a horizontal surface extending between said first and second inclined surfaces for receiving a force applied to said horizontal surface as a result of finger depression so that said key and said third contact engagement means are depressed towards said third contacts, thereby moving said third contact engagement means into engagement with said third contacts;

wherein of said first set of four key-switch assembly means:

said key of the key-switch assembly means of said first set for the finger tip of the first finger of the right hand of the operator has the letter "L" maked on said first inclined surface thereof, the letter "T" marked on said horizontal surface thereof, and the letter "Y" marked on said second inclined surface thereof, said key of the key-switch assembly means of said first set for the finger tip of the second finger of the right hand of the operator has the letter "U" marked on said first inclined surface thereof, the letter "I" marked on said horizontal surface thereof, and the letter "K" marked on said second inclined surface thereof;

said key of the key-switch assembly means of said first set for the finger tip of the third finger of the right hand of the operator has the letter "M" marked on said first inclined surface thereof, the letter "O" marked on said horizontal surface thereof, and the letter "P" marked on said second inclined surface thereof, and said key of the key switch assembly means of said first set for the finger tip of the fourth finger of the right hand of the operator has the letter "G" marked on said first inclined surface thereof, the letter "N" marked on said horizontal surface thereof; and wherein of said second set of four key-switch assembly means:

said key of the key-switch assembly means of said second set for the finger tip of the first finger of the left hand of the operator has the letter "D" marked on said first inclined surface thereof, the letter "E" marked onsaid horizontal surface thereof, and the letter "B" marked on said second inclined surface thereof, said key of the key switch assembly means of said second set for the finger tip of the second finger of the left hand of the operator has the letter "C" marked on said first inclined surface thereof, the letter "R" marked on said horizontal surface thereof, and the letter "V" marked on said second inclined surface thereof;

said key of the key-switch assembly means of said second set for the finger tip of the third finger of the left hand of the operator has the letter "F" marked on said first inclined surface thereof, the letter "A" marked on said horizontal surface thereof, and the letter "X" marked on said second inclined surface thereof, and said key of the key-switch assembly means of said second set for the finger tip of the fourth finger of the left hand of the operator has the letter "W" marked on said first inclined surface thereof, the letter "H" marked on said horizontal surface thereof, and the letter "Q" marked on said second inclined surface thereof.

11. An apparatus as defined in claim 10, wherein:

said key for the second finger of the right hand is connected to said base so that when the second finger of the right hand is placed on said key the longitudinal axis of the second finger of the right hand is aligned with the longitudinal axis of the right forearm;

said other keys of said first set of four key-switch assembly means are connected to said base so that each said key is aligned with the axis of finger extension and finger contraction for the respective finger;

said key for the second finger of the left hand is connected to said base so that when the second finger of the left hand is placed on said key the longitudinal axis of the second finger of the left hand is aligned with the longitudinal axis of the left forearm; and said other keys of said second set of four key-switch assembly means are connected to said base so that each said key aligned with the axis of finger extension and finger contraction for the respective finger.

* * * * *